US008833442B2

(12) United States Patent
Ibragimov et al.

(10) Patent No.: US 8,833,442 B2
(45) Date of Patent: Sep. 16, 2014

(54) WEDGE DEFLECTING DEVICE FOR SIDETRACKING

(71) Applicant: Otkrytoe Aktsionernoe Obschestvo "Tatneft" IM. V.D.Shashina, Almetievsk (RU)

(72) Inventors: Nail Gabdulbarievich Ibragimov, Almetievsk (RU); Marat Marsovich Zalyatov, Almetievsk (RU); Farit Foatovich Akhmadishin, Almetievsk (RU); Almaz Adgamovich Mukhametshin, Bugulma (RU); Marat Azatovich Ismagilov, Bugulma (RU)

(73) Assignee: Otkrytoe Aktsionernoe Obschestvo "Tatneft" IM. V.D.Shashina, Tatarstan (RU)

( * ) Notice: Subject to any disclaimer, the term of this patent is extended or adjusted under 35 U.S.C. 154(b) by 70 days.

(21) Appl. No.: 13/681,784

(22) Filed: Nov. 20, 2012

(65) Prior Publication Data

US 2013/0319653 A1 Dec. 5, 2013

(30) Foreign Application Priority Data

Nov. 23, 2011 (RU) ..... 2011147672

(51) Int. Cl.
*E21B 7/06* (2006.01)

(52) U.S. Cl.
CPC ..... *E21B 7/061* (2013.01)
USPC ..... 166/117.6

(58) Field of Classification Search
USPC ..... 166/255.2, 255.3, 117.5, 117.6, 134, 166/55, 50; 175/61, 81, 82
See application file for complete search history.

(56) References Cited

U.S. PATENT DOCUMENTS 5,113,938 A 5/1992 Clayton
5,437,340 A * 8/1995 Lee et al. ..... 175/61
5,443,129 A * 8/1995 Bailey et al. ..... 175/45

(Continued)

FOREIGN PATENT DOCUMENTS

RU 2164282 C1 3/2001
RU 2166058 C2 4/2001

(Continued)

OTHER PUBLICATIONS

English abstract of SU 1564319 A1.

(Continued)

*Primary Examiner* — Daniel P Stephenson
(74) *Attorney, Agent, or Firm* — Ladas & Parry LLP

(57) ABSTRACT

A wedge deflecting device useful in drilling and workover operations on oil and gas wells. The device includes a cutting tool connected to the upper portion of the wedge by means of the shear element provided with an external circular groove, located below the wedge deflecting surface, and with a transverse slot in its upper part, the cutting tool having a longitudinal cylinder and a downwards spring-biased piston, inserted into the cylinder; above lower seal elements and below the spring the piston has a wedge nose which corresponds to a transverse slot of the shear element. Below the piston, the cylinder communicates with the drill string and the supply tube, and above-the-piston space communicates with the borehole interior. The cutting tool is provided with a radial inward spring-biased locking element, arranged to be able to fix the piston in its top position, where the piston is located above the shear element.

1 Claim, 2 Drawing Sheets

(56) References Cited

U.S. PATENT DOCUMENTS

Figure 1:
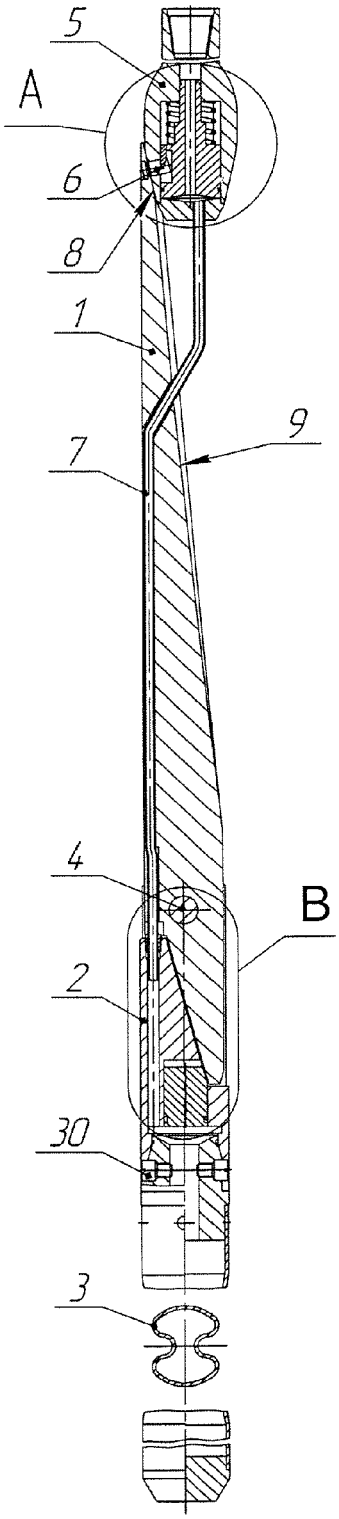

| | | | | |
|---|---|---|---|---|
| 5,816,324 | A | 10/1998 | Swearingen et al. | |
| 5,887,655 | A * | 3/1999 | Haugen et al. | 166/298 |
| 6,648,068 | B2 * | 11/2003 | Dewey et al. | 166/50 |
| 7,325,630 | B2 * | 2/2008 | Takhaundinov et al. | 175/269 |
| 7,878,253 | B2 * | 2/2011 | Stowe et al. | 166/376 |
| 8,069,920 | B2 * | 12/2011 | Cronley et al. | 166/255.3 |
| 8,186,458 | B2 * | 5/2012 | Dewey et al. | 175/61 |
| 8,245,774 | B2 * | 8/2012 | Carter et al. | 166/117.5 |
| 8,469,096 | B2 * | 6/2013 | McGarian | 166/298 |
| 2013/0319653 | A1 * | 12/2013 | Ibragimov et al. | 166/117.6 |

FOREIGN PATENT DOCUMENTS

| | | | |
|---|---|---|---|
| RU | 2 263 196 | C1 | 10/2005 |
| RU | 2 366 793 | C1 | 9/2009 |
| SU | 1564319 | A1 | 5/1990 |

OTHER PUBLICATIONS

English abstract of RU 2 263 196 C1.
English abstract of RU 2 366 793 C1.
English abstract of RU 2166058 C2.
English abstract of RU 2164282 C1.

* cited by examiner

B

*Enlarged view*

WEDGE DEFLECTING DEVICE FOR SIDETRACKING

The present invention relates to drilling and performing workover operations on oil and gas wells, in particular, for sidetracking from earlier drilled cased and open-hole boreholes.

From the prior art a setting tool for wedge deflecting device is known (SU 1564319 A1), including the following elements: a housing with an axial cylindrical channel for circulation of drilling fluid; in-channel positioned piston, spring-biased against the housing; a fixing unit, connected to the piston and comprising a sleeve with a radial hole, coaxially installed in below-the-piston cavity of the housing's cylindrical channel and rigidly connected to it; a rod, located inside the sleeve and rigidly connected to the piston, and a pin, inserted into the sleeve radial hole; besides, the rod from the pin's side has a longitudinal groove inclined to the piston, and the pin is positioned in the groove.

The known prior art device allows to run the deflecting device in the hole and disconnect a drilling string from it under action of the drilling fluid pressure.

However, it has several disadvantages:

- In case the deflecting device is run up to plug back total depth, to fix it reliably in the borehole, an axial load of at least 50 kN is to be created. At such a load, the pin will be distorted and jammed in the sleeve hole, which will make impossible to disconnect the device from the deflecting device, and cause an emergency situation;
- a solid, stable, faceted plug back is required to install and fix the deflecting device in the borehole, which leads to increase of terms and costs of the well construction;
- narrow field of application, connected with impossibility of bringing to the end of the design axial load, required to extend an anchor slip and firmly fix the wedge deflecting device in horizontal sections of directional wells with bending profiles, or in wells with complex profiles;
- necessity of additional round-trip operation to run-in a mill assembly, which results in a well construction time increase.

Another prior art device for sidetracking from a cased borehole is described in RU 2263196 C1. It comprises a deflecting wedge with a fixing mechanism in form of a corrugated pipe with plugged-up one end between which a sub is located; a movable joint, connecting the sub to the wedge; a cutting tool; a channel for fluid delivery into the corrugated pipe, arranged as a hydraulic line, located in the deflecting wedge and communicating the corrugated pipe cavity with a drillpipe internal space and the cavity of the cutting tool, attached to the upper portion of the wedge by means of a shear bolt.

The device has the following disadvantages:

- the complexity of creating secure shear bolt joint of the hydraulic line with the wedge body due to insufficient thickness of the upper portion of the wedge, which can reduce the reliability of the device and lead to a breakdown, increasing well construction costs;
- low reliability of operation of a unit, deflecting the wedge head to the wellbore wall, and fixing it in the position, in particular, in horizontal sections of directional/multilateral wells because of small application arm of the deflecting force at the lower portion of the wedge and, as a consequence, small wedge-to-wall deviating force, impossibility of fixing the wedge in the position during the entire lateral drilling cycle, that limits the range of original-hole azimuth orientation for the wedge within ±45° from its low wall. This, in turn, leads to complication of a lateral hole profile, increasing its length, and creates problems with running a well liner to the bottom because of its higher rigidity compared to the drilling string rigidity and, consequently, results in a lateral drilling costs increase.
- high risk of emergency situations due to the uncontrollable disconnecting force due to the fact the shear bolt is positioned not perpendicular to the wedge deflecting surface (since it is perpendicular to the axis of the device), which leads to bending of the bolt instead of its shearing;
- narrow field of application, associated with impossibility of use of the disconnecting device of the design in complex profile wells due to the fact that when straining of a drillstring takes place, it tends to take a straightline position and sticks in bending well section because of thickness increase in pipe joints, not allowing to control axial load, applied to the shear bolt, which makes impossible to disconnect the cutting tool from the wedge.

The closest to the present invention by its technical essence is a sidetracking device, disclosed in RU 2366793 C1, comprising a deflecting wedge with a fixing mechanism in form of a corrugated pipe with plugged-up one end, between which an a sub is located; a movable joint, connecting the the sub to the wedge; a fixing unit of the deflecting wedge installed in the sub, made as a fixing element and a piston with a rod, located in a hydraulic cylinder, communicating with the corrugated pipe; further, the upper part of the rod is arranged so that it can interact with the lower portion of the wedge from the side of its deflecting surface; a cutting tool, connected to the upper portion of the wedge by means of shear bolt; a fluid delivery channel, communicating the drillpipe internal space and the cutting tool cavity with the corrugated pipe cavity. Besides, the fluid delivery channel is made in form of a supply tube, and the lower portion of the wedge from its deflecting surface side is arranged as a downward wedge nose with a bevel plane directed oppositely to the wedge deflecting surface; herewith, the upper part of the rod is made in form of a side cut, which can interact with a wedge bevel plane, between which the fixing element is positioned.

The disadvantage of the device lies in its narrow field of application, associated with impossibility of use of the disconnecting device of the design in horizontal sections of directional wells with bending profiles, or in complex profile wells due to the fact that when straining of a drillstring takes place, it tends to take a straightline position and sticks in bending sections because of thickness increase in pipe joints, not allowing to control the axial load, applied to the shear bolt, which makes impossible to disconnect the cutting tool from the whipstock. Emergency situations arising thereof can lead even to loss of the main wellbore, since it is practically impossible to pull out the mill assembly staying in the hole, or mill it up, which leads to well construction time and costs increase.

The technical objects of the present invention are:

- field of application expansion due to opportunity of using it in the complex profile wells;
- increasing reliability of the device in horizontal sections of directional/multilateral wells with bending profiles by way of disconnection of the wedge by the fluid pressure increase; reducing risk of emergency situations by applying redundant methods of disconnection of the cutting tool due to installation of the shear element perpendicularly to the top deflecting surface of the wedge, and fitting-up the shear element with an external circular groove, located below the wedge deflecting surface, which, as a whole, will provide reduction of terms and costs of construction of the complex geometry/horizontal wells with a complex profile.

The said technical object is achieved by means of the suggested wedge deflecting device for sidetracking, including: a deflecting wedge with a hydraulic fixing mechanism, with an sub located therebetween; a movable joint, connecting the sub and the wedge; a deflecting wedge fixing unit, installed in the sub and comprising a fixing element and a piston-rod assembly, located in the hydraulic cylinder, communicating with the fixing unit cavity; besides, the upper part of the rod is arranged so that it can interact with the lower portion of the wedge from the side of its deflecting surface; a cutting tool, run-in on the drillstring and connected to the upper portion of the wedge by means of the shear element; a fluid supply tube, communicating the drillstring internal space and the cutting tool cavity with the fixing unit cavity; furthermore, the lower portion of the wedge from its deflecting surface side is arranged as a downward wedge nose with a bevel plane directed oppositely to the wedge deflecting surface; herewith, the upper part of the rod is made in form of a side cut, interacting with a wedge bevel plane, with the fixing element positioned inbetween.

The novelty lies in the fact that the shear element is provided with an external circular groove, located below the wedge deflecting surface, and with a transverse slot in its upper part, and the cutting tool is provided with a longitudinal cylinder and a downwards spring-biased piston with upper and lower seal elements, inserted into the cylinder; the piston above the lower seal elements and below the spring is equipped with a lateral longitudinal wedge nose, form of which corresponds to the form of the transverse slot of the shear element; besides, below-the-piston space of the longitudinal cylinder communicates with the drillstring and the supply tube, and above-the-piston space communicates with the borehole interior; furthermore, the cutting tool is provided with a radial locking element spring biased inward, arranged in such a way it is able to fix the piston in its top position, in which the piston is located above the shear element.

Figure 2:
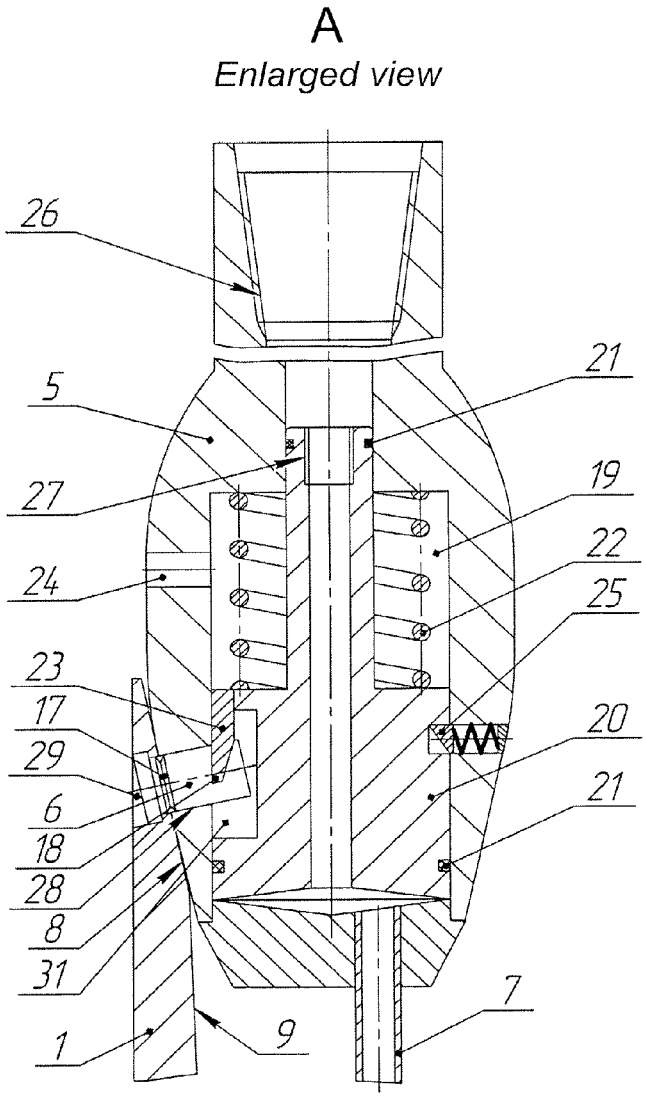
Figure 3:
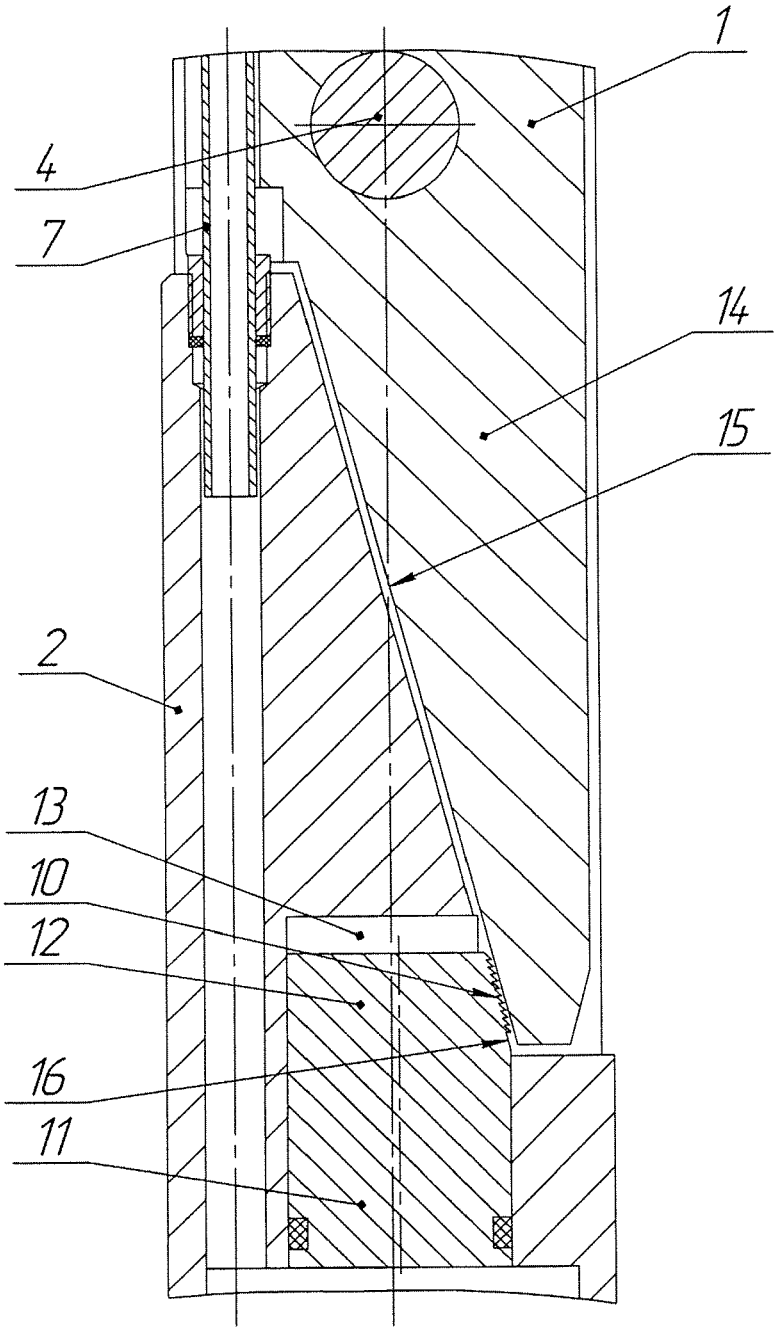

FIG. 1 demonstrates the general cross-sectional view of the wedge deflecting device, FIG. 2 shows a cutting tool to wedge connection unit and a disconnecting device in its run-in position, FIG. 3 shows the deflecting wedge fixing unit.

The device comprises a deflecting wedge 1 (FIG. 1), a sub 2, a hydraulic fixing mechanism 3, made, for instance, in form of a profile pipe, hydraulic anchor or a packer (see RU 2166058, RU 2164282, U.S. Pat. Nos. 5,113,938, 5,816,324), a movable hinge joint between the wedge 1 and sub 2 with an axis 4. There are the following elements installed above the wedge 1: a cutting tool 5 in form of mill assembly, a bypass valve, a tube screen, attached to the drillstring (not shown at FIG. 1), mechanically connected to the wedge 1 by means of the disconnecting device in form of the shear element 6. The supply tube 7 is intended for delivery of drilling fluid from the drillstring through the cutting tool 5 and the sub 2 into internal space of the hydraulic fixing mechanism 3. Guide slot of the wedge 1 comprises two deflecting surfaces: the upper one 8 and the basic one 9 (FIGS. 1 and 2). The sub 2 (FIG. 1) includes a wedge 1 fixing unit, comprising a fixing element 10 (FIG. 3) and a piston 11 with a rod 12, installed in the hydraulic cylinder 13, communicating with the fixing unit 3 (FIG. 1); besides, the top part of the rod 12 (FIG. 3) is installed so that it can interact with the lower portion of the wedge 1 from its deflecting surface 9; therewith, the lower portion of the wedge 1 from its deflecting surface 9 is made in form of a downward wedge nose 14 with a bevel plane 15, directed oppositely to the wedge 1 deflecting surface 9; further, the top part of the piston rod 12 is made in form of a side cut, interacting with the bevel plane 15 of the wedge 1, with the fixing element 10 in form of the notches positioned inbetween (the other types of the notches are possible in accordance with RU 2366793). The shear element 6 (FIG. 2) is provided with an external circular groove 17, located below the deflecting surface 8 of the wedge 1, and with a transverse slot 18 in its upper portion, and the cutting tool 5 is provided with a longitudinal cylinder 19 and a downwards spring-biased piston 20 with upper and lower seal elements 21, inserted into the cylinder 19; the piston 20 above the lower seal elements 21 and below the spring 22 is equipped with a lateral longitudinal wedge nose 23, form of which corresponds to the form of the transverse slot 18 of the shear element 6; besides, below-the-piston space of the longitudinal cylinder 19 communicates with the drillstring and the supply tube 7, and above-the-piston space communicates with borehole interior through the opening 24 in the body of the cutting tool 5; furthermore, the cutting tool 5 is provided with a radial inward spring-biased locking element 25, arranged in such a way it is able to fix the piston 20 in its top position, in which the piston 20 is located above the shear element 6.

In order to simplify the attached drawings, any technological connecting and sealing elements are not shown or shown schematically.

The device operates in the following way.

At the plant the piston 20 (FIG. 2) of the disconnecting device of the cutting tool 5 (window cutting mill) is brought in the operating position by means of a flange (not shown in FIG. 2), positioned on face of its union joint 26, and an adjuster bolt (not shown in FIG. 2), inserted into the flange and screwed into thread 27, provided on the upper part of the piston 20, whereby the spring 22 is compressed, diverting the piston 20 with the wedge nose 23 to open passage area of the opening 28 for the shear element 6. The shear element 6 is attached to the wedge 1 by way of inserting it perpendicular to the upper deflecting surface 8 into the opening 29 in the upper portion 15 of the wedge, and secured (for instance, by soldering, welding, calking, mechanical attachment, etc., not shown in FIG. 2) such that transverse slot 18 was located perpendicular to the axis of the device and directed to the headpiece of the wedge 1 (i.e., upward). The cutting tool 5 is attached to the wedge 1 by way of inserting the shear element 6 into the opening 28 of the cutting tool 5. After screwing back the adjustment bolt, the cutting tool 5 is fixed on the wedge 1 by means of the transverse slot 18 of the shear element 6 and the wedge nose 23 of the piston 20 and the spring 22. Spring 22 force and the wedge-shaped form of the nose 23 make it possible to press the cutting tool 5 against the wedge 1 and fix it securely in the position for the period of transportation, RIH, orientation and setting. After that, they remove the adjustment bolt with a flange, attach the supply tube 7 to the cutting tool 5, and blank off the union joint 26 (not shown in FIG. 2). The wedge 1 is connected to the sub 2 with the axis 4 (FIG. 1). The bottom end of the sub 2 is blanked off (not shown in FIG. 1). In such form, the wedge 1 with the sub is ready for storage and transportation.

Before RIH, the wedge deflecting device is assembled on a walkway in the following sequence: protective plugs are removed from the union joint 26 of the cutting tool 5 and the sub 2 (FIG. 1), the wedge 1 with the sub 2 is connected to the hydraulic fixing mechanism 3, for instance, with a thread (not shown in FIG. 1) or countersunk bolts 30, and run in the hole at the elevator (not shown on FIG. 1).

A drillpipe with a tube screen above is connected to the cutting tool 5 (FIG. 2) through the union joint 26, and above them a bypass valve is installed (not shown in FIGS. 1 and 2).

The assembly is run down the hole on a drillstring to the depth selected, and the wedge deflecting device is oriented, for example, by means of an inclinometer or a gyroscope (not shown in FIG. 1) in the required direction in azimuth. While running down the hole, operating fluid available downhole comes through the bypass valve and fills-up the cavities of the cutting tool (FIG. 1), drillpipes, and hydraulic fixing mechanism 3, preventing their collapse under action of the fluid head pressure. The tube screen retains large sludge particles getting in the drillstring cavity through bypass valve, preventing plugging of the supply tube 7. During running of the device into the well, due to cyclic character of the operation and stop of the drillstring at rotary slips for drillpipe connection, there are hydraulic impacts taking place in the drillstring cavity, which transfer to the longitudinal cylinder 19 (FIG. 2) of the cutting tool 5, and affect the piston 20. Compression force of the spring 22 exceeds the hydraulic impacts force, buffers them, and thus, excludes inadvertent disconnection of the cutting tool 5 from the wedge 1.

When the wedge deflecting fevice reaches the setting interval, a pump from the wellhead creates an operating fluid pressure within the drillstring, which, through the cutting tool 5 (FIG. 1) by the supply tube 7 and the sub 2, is transferred to the hydraulic fixing mechanism 3, bringing it to operating position and anchoring it securely in the borehole. At the same time, the operating fluid pressure displaces the piston 11 (FIG. 3) with the rod 12, which, acting with its side cut 16 on the bevel plane 5 of the wedge nose 14, turns the wedge 1 (FIG. 1) around the axis 4 and presses its headpiece (i.e., the upper portion of the wedge 1) against the borehole wall (not shown in FIG. 1). Arranging of the wedge nose 14 (FIG. 3), directed downwards, with the bevel plane 15, oriented inversely relative to the wedge 1 deflecting surface 9 and interacting with the upper part of the rod 12, allows us to increase the arm of force application to the upper part of the wedge in any required ratio, regardless of well diameter or internal diameter of the casing (not shown in FIGS. 1 and 3), which ensures pressing of the wedge 1 upper portion (FIG. 1) to the borehole wall with higher force and its secure fixing in the position during all the time of sidetracking, drilling and casing operations. In its top position, the piston 11 (FIG. 3) and the rod 12 are blocked between the hydraulic cylinder 13 wall and the lower wedge 1 nose 14 by means of the notches 10. Construction of the rod 12 with the piston 11 as a single integrated cylinder, combined with the fixing element 10, allows to simplify design of the bearing assembly, increase its strength, reliability, and reduce dimensions. In case the device is used in large-diameter boreholes, for example, in surface casing, the rod 12 with the piston 11 construction can be implemented as a split-type one to simplify the technique and reduce manufacturing costs. Large diameter and length of the piston 11 allow it to work steadily, leaving deflecting/wedging function for the rod 12. Design of the rod 12 in form of a wedge increases deflecting force and the wedge headpiece-to-wall pressing force, and makes it possible to reliably fix the wedge in the position, since the wedging force of the rod 12 is many times higher than the axial force, created by the operating fluid pressure on the piston 11. Furthermore, the deflection forces, induced in the wedge during operation process, affect the wedge not in axial direction, but perpendicular to the side cut 16 surface of the rod 12, not shifting the piston 11 to the initial position, but increasing its fixation force (other types of the fixing elements are also possible in accordance with RU 2366793).

Reliability of the wedge setting in the well is checked by rated-force drillstring straining. Then, creating a pressure, exceeding the hydraulic fixing mechanism 3 activation pressure (FIG. 1), the spring 22 is compressed by the piston 20 (FIG. 2) with upper and lower seal elements 21, bringing the wedge nose 23 out of the transverse slot 18 of the shear element 6, disconnecting the cutting tool 5 from the wedge 1; at the same time, the fluid is removed through the opening 24 from the above-the-piston cavity to the borehole. The piston 20, continuing its movement under the fluid pressure effect, rests with the slot lower surface 31 against the shear element 6, and by its slope surface pushes the cutting tool 5 away from the wedge 1 to the opposite side of the borehole. Thereat, bending of the shear element 6 in the transverse slot 18 location area takes place, increasing its angle of tilt to the axis 6 of the device and, thus, increasing by that the force, pushing the cutting tool 5 away from the wedge 1. The piston 20, having passed the shear element 6 zone, is fixed in its top position with the locking element 25. Fluid pressure, acting on the shear element 6 with the fluid jet reaction force, will complete disconnection of the cutting tool 5 from the wedge 1, and open the opening 28. Fluid pressure drop in the drillstring means disconnection of cutting tool 5 from the wedge 1 took place. Detachment of the supply tube 7 from the cutting tool 5 is accomplished by straining the drillstring. Opening of these ports communicates internal cavity of the drilling pipes with the borehole. While milling a window and drilling a lateral, the total area of the openings makes it possible to pump sufficient flush fluid volume and maintaining required speed of the upward flow, carrying out the grit and cement/rock particles from the window milling/sidetracking area, which is not available in the prior art devices. Also, in the process of milling-out the remaining part of the shear element 6, after disconnecting the cutting tool 5 from the wedge 1, the circular groove 17 facilitates its fast destruction, preserving cutting elements of the cutting tool 6, and accelerating the process of cutting out the window and sidetracking.

In case of any complications in the well (for example, plugging of the drillstring internal cavity with scale or some dropped metal parts) and impossibility of disconnecting the cutting tool 5 (FIG. 1) from the wedge 1 with the method described, required detachment is performed by breaking the shear element 6 by the external circular groove 17 (FIG. 2) by way of straining the drillstring with a rated force not exceeding load capacity of the derrick (not shown in FIG. 1). After that, the drillstring is rotated, flush fluid circulation out of the wellbore restarted, and a window in the well casing is milled by way of moving the cutting tool 5 (FIG. 1) across the deflecting surface 8, and later, across the surface 9 of the wedge 1.

As a whole, it allows to expand application field of the suggested device due to possibility of using it in the complex profile wells and increase reliability of its operation in horizontal sections of directional/multilateral wells by way of disconnection of the cutting tool from the whipstock by destructing the shear bolt with fluid pressure increase; to reduce risk of emergency situations by installation of the shear element perpendicularly to the top deflecting surface of the wedge and applying redundant methods of disconnection of the cutting tool from the wedge, which, in total, will provide reduction of construction terms and costs of the complex geometry wells and complex profile horizontal wells.

The invention claimed is:

1. A wedge deflecting device, comprising:

a deflecting wedge with a hydraulic fixing mechanism, with a sub located therebetween;

a movable joint, connecting the sub and the wedge, the wedge comprising a deflecting surface, a lower portion and an upper portion;

a deflecting wedge fixing unit, installed in the sub and comprising a cavity, a hydraulic cylinder, a fixing element and a piston-rod assembly, located in the hydraulic cylinder, communicating with the fixing unit cavity, an upper part of the piston-rod assembly is arranged so that it can interact with the lower portion of the wedge from the side of its deflecting surface;

a cutting tool, run-in on a drillstring and connected to the upper portion of the wedge by means of a shear element; a fluid supply tube, communicating a drillstring internal space and a cutting tool cavity with the fixing unit cavity, the lower portion of the wedge from its deflecting surface side is arranged as a downward wedge nose with a bevel plane, directed oppositely to the wedge deflecting surface;

wherein the upper part of the piston-rod assembly comprises a side cut, interacting with a wedge bevel plane, with the fixing element positioned in-between;

wherein the shear element is provided with an external circular groove, located below the wedge deflecting surface, and with a transverse slot in an upper part thereof, the cutting tool is provided with a longitudinal cylinder and a downward spring-biased piston with upper and lower seal elements, inserted into the cylinder; the piston above the lower seal elements and below the spring is equipped with a lateral longitudinal wedge nose, the longitudinal wedge nose having a shape which corresponds to the shape of the transverse slot of the shear element;

a below-the-piston space of the longitudinal cylinder communicates with the drillstring and the fluid supply tube;

an above-the-piston space communicates with a borehole interior;

wherein the cutting tool is provided with a radial inward spring-biased locking element, arranged so that it is able to fix the piston in a top position, in which the piston is located above the shear element.

* * * * *